US008570231B2

(12) United States Patent
Desclos et al.

(10) Patent No.: US 8,570,231 B2
(45) Date of Patent: Oct. 29, 2013

(54) ACTIVE FRONT END MODULE USING A MODAL ANTENNA APPROACH FOR IMPROVED COMMUNICATION SYSTEM PERFORMANCE

(71) Applicant: Ethertronics, Inc., San Diego, CA (US)

(72) Inventors: Laurent Desclos, San Diego, CA (US); Barry Matsumori, La Jolla, CA (US); Sebastian Rowson, San Diego, CA (US); Jeffrey Shamblin, San Marcos, CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

(21) Appl. No.: 13/674,081

(22) Filed: Nov. 11, 2012

(65) Prior Publication Data

US 2013/0154889 A1 Jun. 20, 2013

Related U.S. Application Data

(63) Continuation-in-part of application No. 13/029,564, filed on Feb. 17, 2011, now Pat. No. 8,362,962, which is a continuation of application No. 12/043,090, filed on Mar. 5, 2008, now Pat. No. 7,911,402, application No. 13/674,081, which is a continuation-in-part of application No. 13/289,901, filed on Nov. 4, 2011, which is a continuation of application No. 12/894,052, filed on Sep. 29, 2010, now Pat. No. 8,077,116, which is a continuation of application No. 11/841,207, filed on Aug. 20, 2007, now Pat. No. 7,830,320.

(51) Int. Cl.
*H01Q 9/38* (2006.01)

(52) U.S. Cl.
USPC ..... 343/745; 343/749; 343/750; 343/818

(58) Field of Classification Search
USPC ..... 343/722, 745, 749, 750, 815, 817, 818, 343/820, 833, 850
See application file for complete search history.

(56) References Cited

U.S. PATENT DOCUMENTS

| | | | | |
|---|---|---|---|---|
| 5,367,310 | A * | 11/1994 | Warnagiris | 343/745 |
| 6,337,664 | B1 * | 1/2002 | Mayes et al. | 343/749 |
| 6,765,536 | B2 * | 7/2004 | Phillips et al. | 343/702 |
| 6,876,337 | B2 * | 4/2005 | Larry | 343/818 |
| 7,053,845 | B1 * | 5/2006 | Holloway et al. | 343/725 |
| 7,132,989 | B1 * | 11/2006 | Poilasne | 343/745 |
| 7,834,813 | B2 * | 11/2010 | Caimi et al. | 343/745 |

* cited by examiner

*Primary Examiner* — Tho G Phan
(74) *Attorney, Agent, or Firm* — Coastal Patent Law Group, P.C.; Joshua S. Schoonover

(57) ABSTRACT

This application describes a dynamically tuned front end module using a modal antenna approach for improved communication system performance. The front end module consists of power amplifiers, filters, switches and antennas along with tuning circuits integrated and controlled to provide an optimized system for RF transmission. Dynamic tuning provides the ability to maintain optimized system performance for a wide variety of use cases and environments that the wireless device is operated in. Several transmission modes are accessed in an algorithm to optimize the performance of multiple wireless devices in a cellular system, to include a power conservation mode, emergency transmission mode, and cell capacity optimization mode. Dynamic adjustment of correlation and isolation between multiple antennas is a benefit provided by this front end topology.

9 Claims, 13 Drawing Sheets

ACTIVE FRONT END MODULE USING A MODAL ANTENNA APPROACH FOR IMPROVED COMMUNICATION SYSTEM PERFORMANCE

CROSS-REFERENCE TO RELATED APPLICATIONS

This application is a CIP of U.S. Ser. No. 13/029,564, filed Feb. 17, 2011, and titled "ANTENNA AND METHOD FOR STEERING ANTENNA BEAM DIRECTION", which is a CON of U.S. Ser. No. 12/043,090, filed Mar. 5, 2008, titled "ANTENNA AND METHOD FOR STEERING ANTENNA BEAM DIRECTION", now issued as U.S. Pat. No. 7,911,402; and a CIP of U.S. Ser. No. 13/289,901, filed Nov. 4, 2011, titled "ANTENNA WITH ACTIVE ELEMENTS", which is a CON of U.S. Ser. No. 12/894,052, filed Sep. 29, 2010, titled "ANTENNA WITH ACTIVE ELEMENTS", now U.S. Pat. No. 8,077,116, which is a CON of Ser. No. 11/841,207, filed Aug. 20, 2007, titled "ANTENNA WITH ACTIVE ELEMENTS", now U.S. Pat. No. 7,830,320;

the contents of each of which are hereby incorporated by reference.

BACKGROUND OF THE INVENTION

1. Field of the Invention

The present invention relates to front end modules and antennas for use in mobile communication devices and more particularly to a dynamically tuned front end module and antenna assembly to enhance the performance of communication systems.

2. Description of the Related Art

As new generations of handsets and other wireless communication devices become smaller and/or embedded with more applications, new antenna designs as well as front end architectures will be required to address inherent limitations of these devices. With classical antenna structures, a certain physical volume is required to produce a resonant antenna structure at a particular radio frequency and with a particular bandwidth. In multi-band applications, more than one such resonant antenna structure may be required.

A common problem encountered in mobile wireless communication systems is the de-tuning effects incurred on the antenna due to the multiple use cases for the device. As the antenna de-tunes, the impedance presented by the antenna to the power amplifier and receiver varies, which in turn reduces the power transfer through the front end (power amplifier, switch assembly, filters, and antenna). The result is reduced communication range as well as reduced data rate for the communication device. With a passive antenna and fixed impedance matching circuit, the front end can only be optimized for a single use case such as device held in the user's hand, device against the user's head, or placement of the device on a surface such as a table or dashboard of an automobile. However, in practice a device may be used while in any of a plurality of such use cases, thus the antennas within are not properly tuned against these environmental factors.

SUMMARY OF THE INVENTION

Accordingly, it is an object of the present invention to solve these and other problems in the art by providing a tunable front end circuit which includes one or more antennas in a mobile device or other communication system to enhance performance at the respective communication frequency bands.

It is another objective to provide an antenna front end module capable of resisting detuning effects across a plurality of environmental conditions or use cases.

In keeping with these objectives and with others which will become apparent hereinafter, an improved front end circuit design is provided, wherein the

DETAILED DESCRIPTION OF THE PREFERRED EMBODIMENTS

Figure 1:
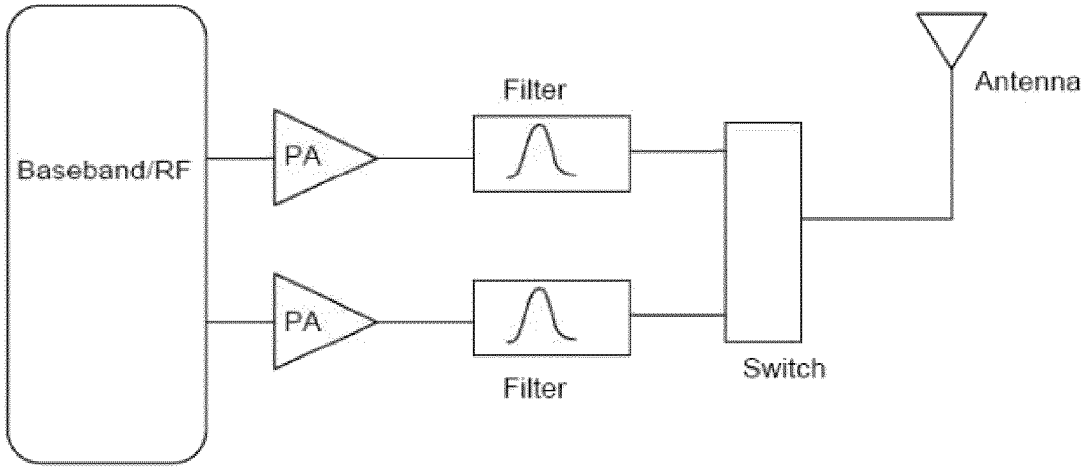
FIG. 1 illustrates a front end architecture for use in wireless communications circuits.

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

Commonly owned, U.S. Pat. No. 7,911,402, titled "ANTENNA AND METHOD FOR STEERING ANTENNA BEAM DIRECTION", and U.S. Pat. No. 7,830,320, titled "ANTENNA WITH ACTIVE ELEMENTS", disclose antenna systems capable of beam steering, band switching, active matching, and other active tunable characteristics; the contents of each of which are hereby incorporated by reference. These antennas utilize a radiating element and one or more parasitic elements coupled to active elements in a manner for enabling switching, variable reactance, and other tuning of the antenna components. The resulting structure is an active tunable antenna capable of operating in multiple modes, otherwise termed an "active modal antenna" or "modal antenna". The referenced patents disclose active modal antennas and thus details of these structures will not be discussed in detail herein.

An "active modal antenna" as referred to herein includes an antenna capable of selective operation about a plurality of modes, wherein each of said plurality of modes generates a distinct antenna radiation pattern resulting from the first active modal antenna. In this regard, the active modal antenna can be reconfigured as necessary to provide an optimal radiation pattern. This is accomplished by one or more of: band-switching, beam steering, and active impedance matching as environmental effects detune the antenna. In representative examples, an active modal antenna comprises a radiating structure disposed above a circuit board and forming an antenna volume therebetween; a parasitic element positioned adjacent to the radiating structure; and an active element coupled to the parasitic element; wherein the active element is configured for one or more of: adjusting a reactance of the parasitic element, or shorting the parasitic element to ground.

In certain embodiments of the invention, a tunable front end module comprises: one or more power amplifier modules, one or more adaptive filter modules or fixed filters, one or more active antenna elements, and an algorithm to provide adaptive tuning of the power amplifier modules, adaptive filter modules, and active antenna elements for optimal transmission through the transceiver front end.

The tunable front end module can be programmed to comprise one or more algorithms. For example, the tunable front end module can comprise an algorithm containing a propagation mode for power conservation where power consumption of the power amplifier module is reduced. Battery use rate is monitored and adjustments are made to the power amplifier to conserve battery power. Power to one or multiple RF chains is turned off, resulting in operation of a voice channel only, or a data channel only. Power to the active components to one or multiple antennas is turned off, resulting in battery power conservation. Power to the active components to one or multiple filter modules is turned off, resulting in battery power conservation.

In another embodiment, the tunable front end module can comprise an algorithm containing a propagation mode for cell capacity optimization where the antenna beam state of the mobile transceiver is selected on one or multiple mobile transceivers within a cell to reduce interference and increase overall cell capacity. The antenna beam state of one or multiple mobile transceivers is commanded to select a beam that optimizes mobile transceiver performance by communicating with an adjacent base station.

In another embodiment, the tunable front end module can comprise an algorithm containing a propagation mode for cell capacity optimization where the frequency band of one or multiple mobile transceivers is selected to optimize overall cell capacity. One or multiple mobile transceivers are commanded to switch to an alternate frequency band to relieve congestion within a cell.

In another embodiment, the tunable front end module can comprise an algorithm containing a propagation mode for emergency operation where the antenna and front end module is configured for maximum radiated power. The radiated power level is optimized to exceed regulated power levels for an emergency transmission. The adaptive filter modules are configured for reduced insertion loss to increase total radiated power.

In another embodiment, the tunable front end module can comprise an algorithm containing a propagation mode for emergency operation where multiple antennas are configured into an array to increase antenna gain for increased total radiated power. The radiated power level is optimized to exceed regulated power levels for an emergency transmission. The adaptive filter modules are configured for reduced insertion loss to increase total radiated power.

In another embodiment, the tunable front end module can comprise an algorithm that adjusts correlation between antennas based on system throughput metrics. The correlation between antennas is altered by selecting the optimal antenna beam state of one or multiple antennas. The correlation is varied by dynamically tuning portions of the tunable front end module to alter the impedance properties of one or more of transmit or receive paths.

In yet another embodiment, the tunable front end module can comprise an algorithm that adjusts isolation between antennas based on sampled coupling between transmit and/or receive paths. The isolation between antennas is altered by selecting the optimal antenna beam state of one or multiple antennas. The isolation is varied by dynamically tuning portions of the tunable front end module to alter the impedance properties of one or more of transmit or receive paths.

In certain embodiments of the invention, an adaptive coupled line filter comprises: two or more coupled conductors, one or more tuning components attached to one or more of the conductors. The conductors can be fabricated using microstrip lines, co-planar waveguide (CPW), or stripline conductors. The tuning component or components can be adjusted to shift the frequency response of the filter. One or more switches can be used to connect one or more tuning components to the conductors to connect or disconnect the tuning component from the conductor. The tuning components can be switches, Barium Strontium Titanate (BST) capacitors, PIN diodes, varactor diodes, MEMS switches, MEMS switched capacitors, and phase shifters, or other active tuning components.

Now turning to the drawings, FIG. 1 illustrates a front end circuit architecture for a mobile wireless device. Baseband and RF modules are connected to power amplifiers (PA), filters, a switch, and an antenna.

Figure 2:
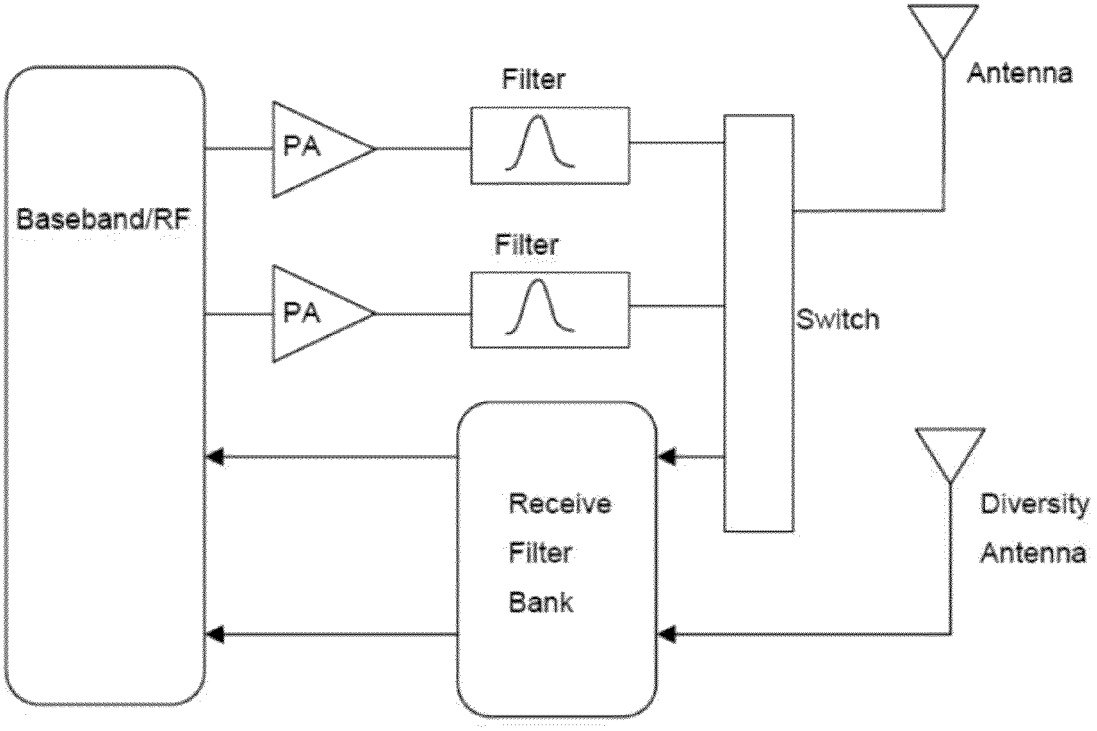
FIG. 2 illustrates a front end architecture designed for receive diversity within a wireless communications device.

FIG. 2 illustrates a front end circuit architecture for a mobile wireless device utilizing receive diversity. Baseband and RF modules are connected to power amplifiers (PA), filters, a switch, and an antenna. A second antenna is used to operate over the receive bands and is connected to a filter bank.

Figure 3:
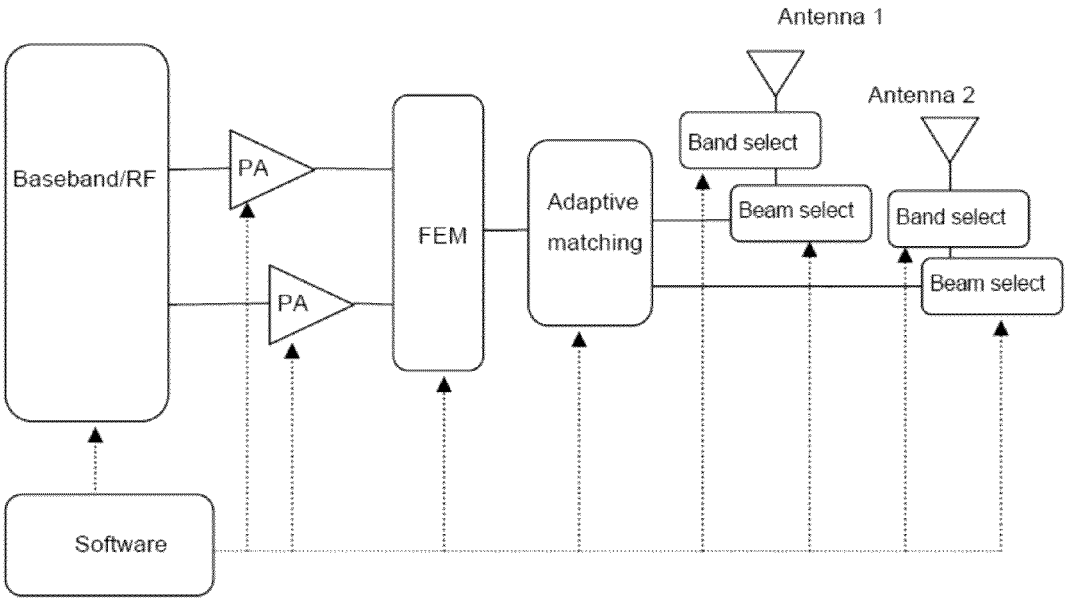
FIG. 3 illustrates an active front end circuit topology in accordance with embodiments herein.

FIG. 3 illustrates an active front end circuit topology in accordance with embodiments herein, wherein control of the PA module, adaptive filters, and active antenna provide a more capable communication system. Beam switching and frequency band switching functions are provided by the antennas. Comprehensive software provides an algorithm to synchronize the various components to optimize the communication link.

Figure 4:
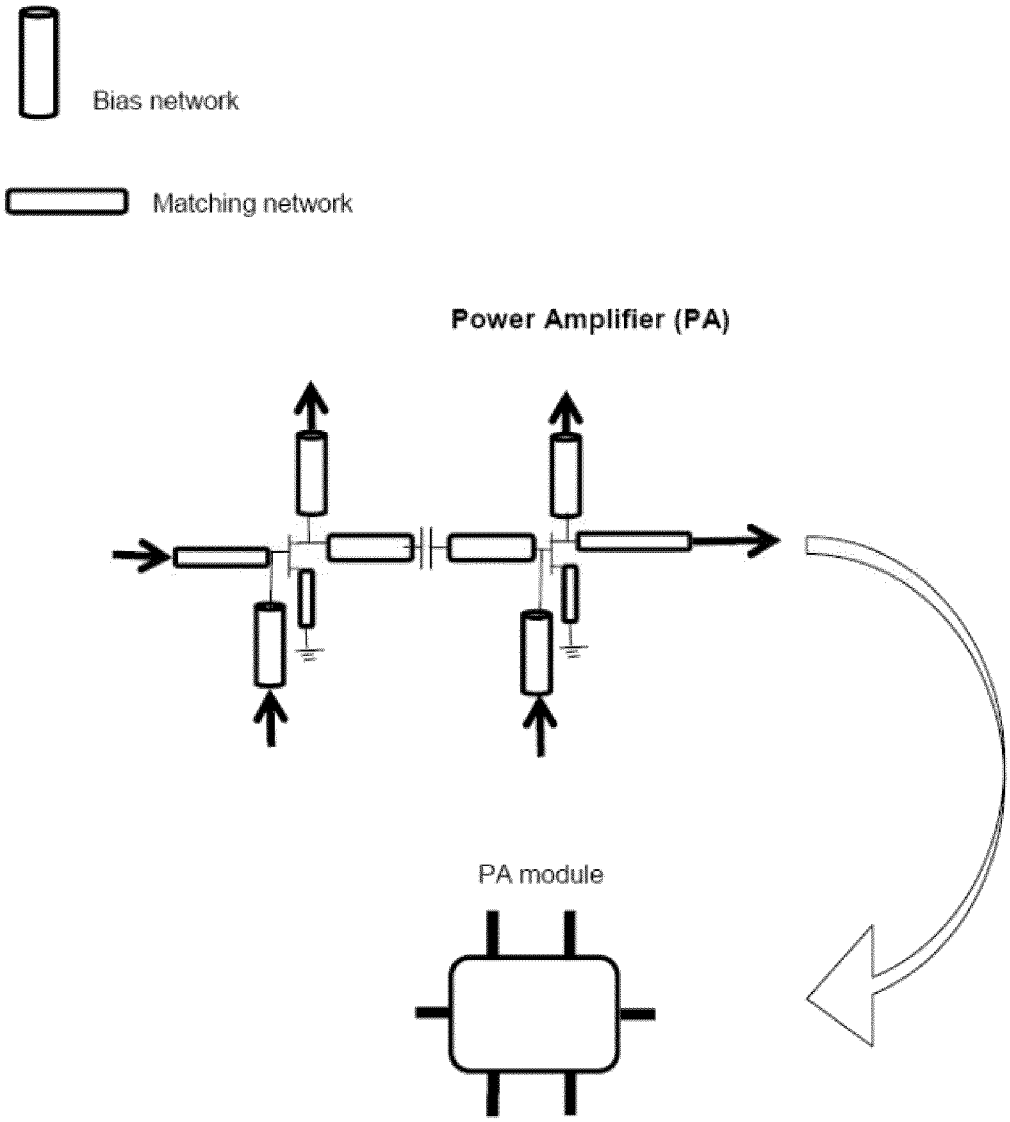
FIG. 4 illustrates a power amplifier module in accordance with embodiments herein, matching networks and bias networks are combined to form the power amplifier module.

FIG. 4 illustrates a power amplifier configured into a module. Bias networks and matching networks are provided, and the matching networks are dynamically tunable to optimize the performance of the PA module. A wide variety of tuning components can be integrated to provide dynamic tuning: switches, Barium Strontium Titanate (BST) capacitors, PIN diodes, varactor diodes, MEMS switches, MEMS switched capacitors, and phase shifters. The tuning component is not limited to this list.

Figure 5:
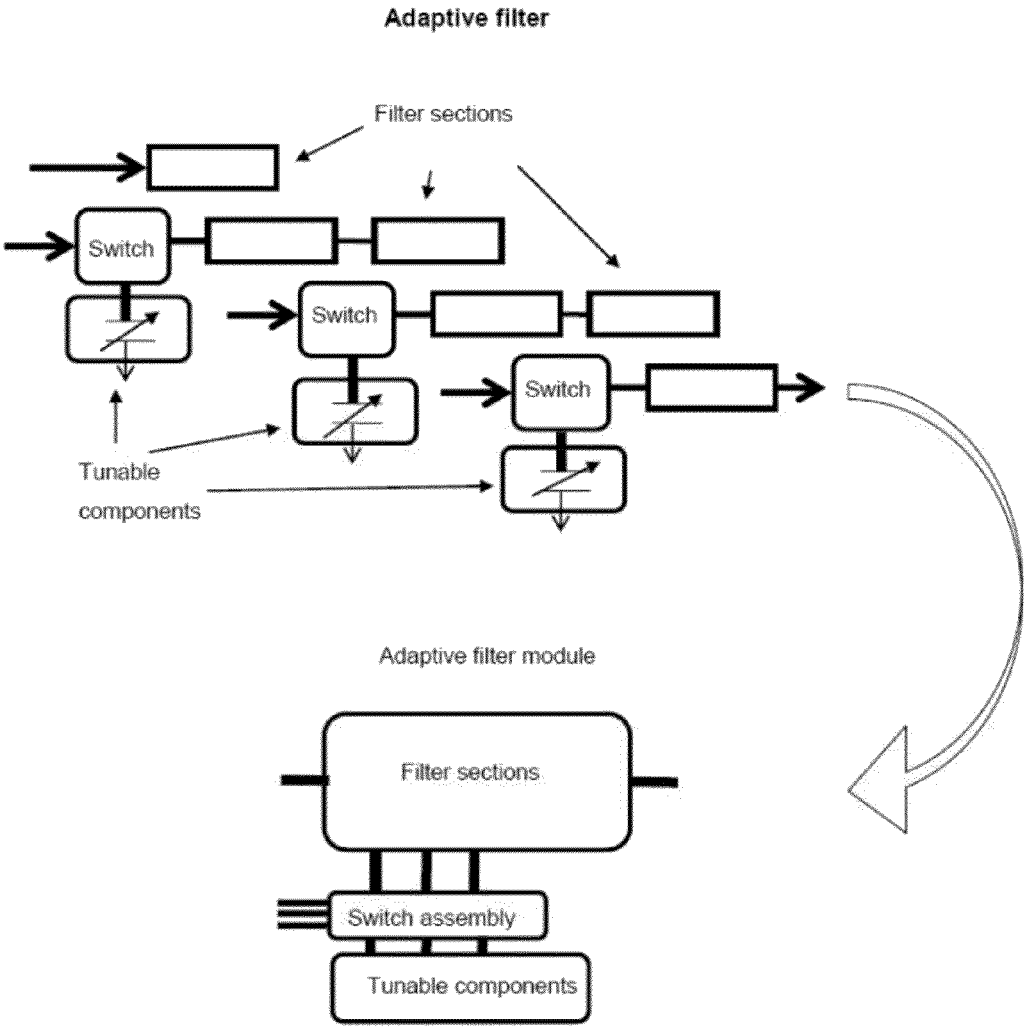
FIG. 5 illustrates an adaptive filter module according to embodiments herein, filter sections, a switch assembly, and tunable matching components are combined to provide dynamic tuning and adjustment of the filter response.

FIG. 5 illustrates an adaptive filter module. Filter sections, a switch assembly, and tunable matching components are combined to provide dynamic tuning and adjustment of the filter response.

Figure 6:
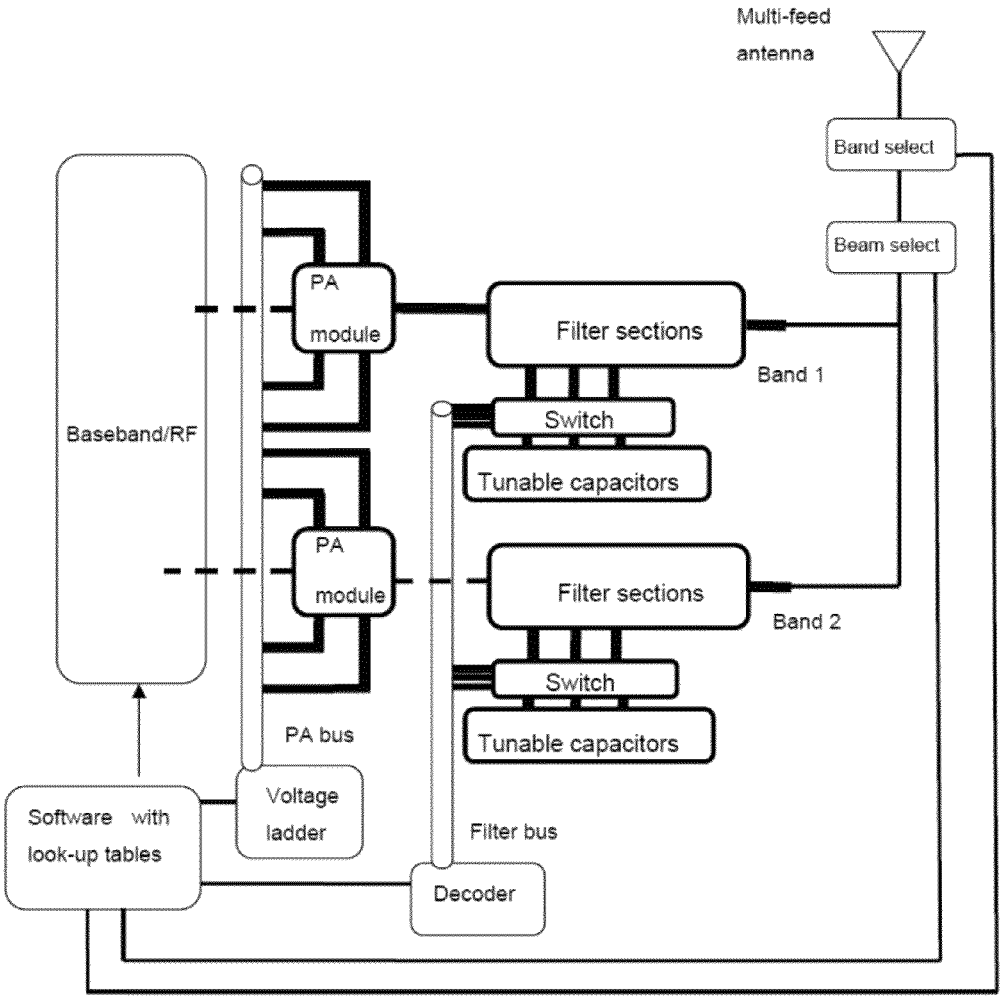
FIG. 6 illustrates a tunable front end module in accordance with an embodiment herein; software is used to synchronize and control multiple PA modules, adaptive filter modules, and one or multiple active antennas.

FIG. 6 illustrates a dynamically tunable front end module (FEM). Software is used to synchronize and control multiple PA modules, adaptive filter modules, and one or multiple active antennas.

Figure 7:
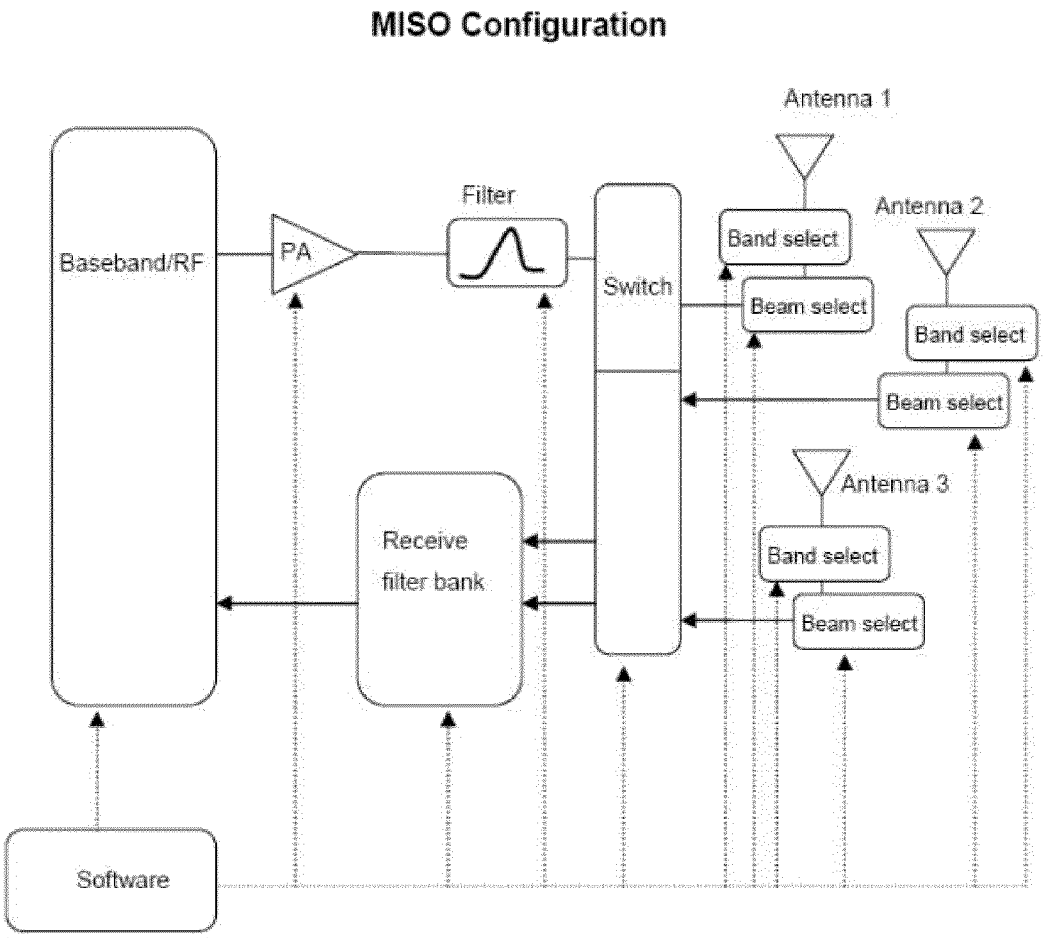
FIG. 7 illustrates a MISO front end topology in accordance with an embodiment herein.

FIG. 7 illustrates a Multiple Input Single Output (MISO) RF front end topology where beam switching and frequency band switching functions are provided by the antennas. One transmit section includes a power amplifier, filter, switch, and antenna with beam and band switching functionality. Two receive antennas with beam and band switching functionality each contains dynamic a tuning circuit. Isolation between the three antennas as well as correlation between the three antennas can be optimized by dynamically adjusting the impedance properties of the antennas as well as choosing the optimal radiation pattern beam state.

Figure 8:
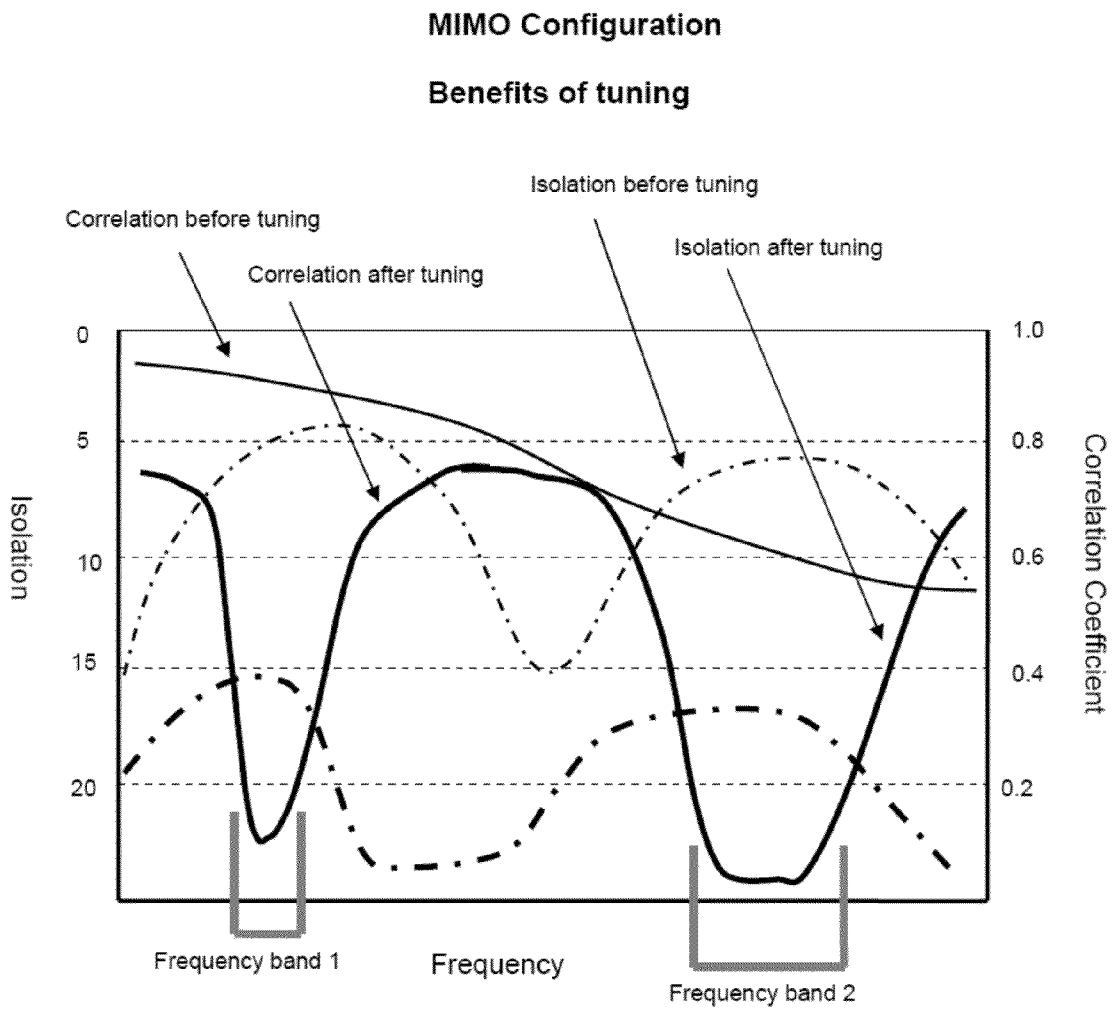
FIG. 8 illustrates a plot of isolation and correlation coefficient improvement that can be obtained when dynamic tuning and beam select is implemented in the antennas.

FIG. 8 illustrates a plot of isolation and correlation coefficient improvement that can be obtained when dynamic tuning and beam select is implemented in the antennas. The impedance properties of the antennas can be altered to improve isolation at the frequency bands of interest. The impedance properties as well as beam state can be chosen to decrease correlation between the antennas.

Figure 9:
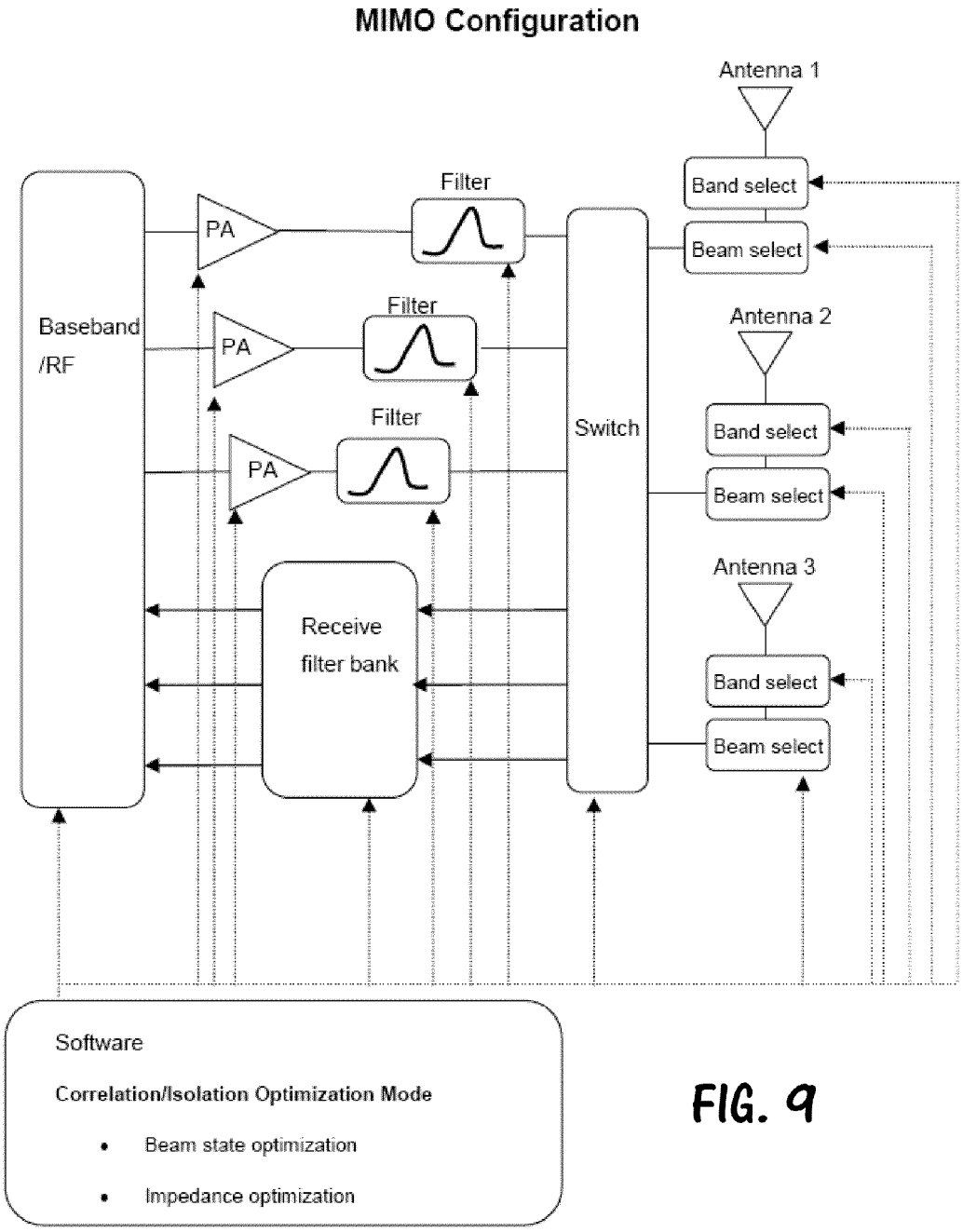
FIG. 9 illustrates a MIMO front end topology in accordance with an embodiment herein.

FIG. 9 illustrates a MIMO (Multiple Input Multiple Output) RF front end topology where beam switching and frequency band switching functions are provided by the antennas. A 3×3 MIMO configuration is illustrated where three transmit sections, each including a power amplifier, filter, switch, and antenna with beam and band switching functionality is configured to provide three independent transmit paths. Three independent receive paths are provided where the receive signals are routed through a filter bank. Isolation between the three antennas as well as correlation between the three antennas can be optimized by dynamically adjusting the impedance properties of the antennas as well as choosing the optimal radiation pattern beam state.

Figure 10:
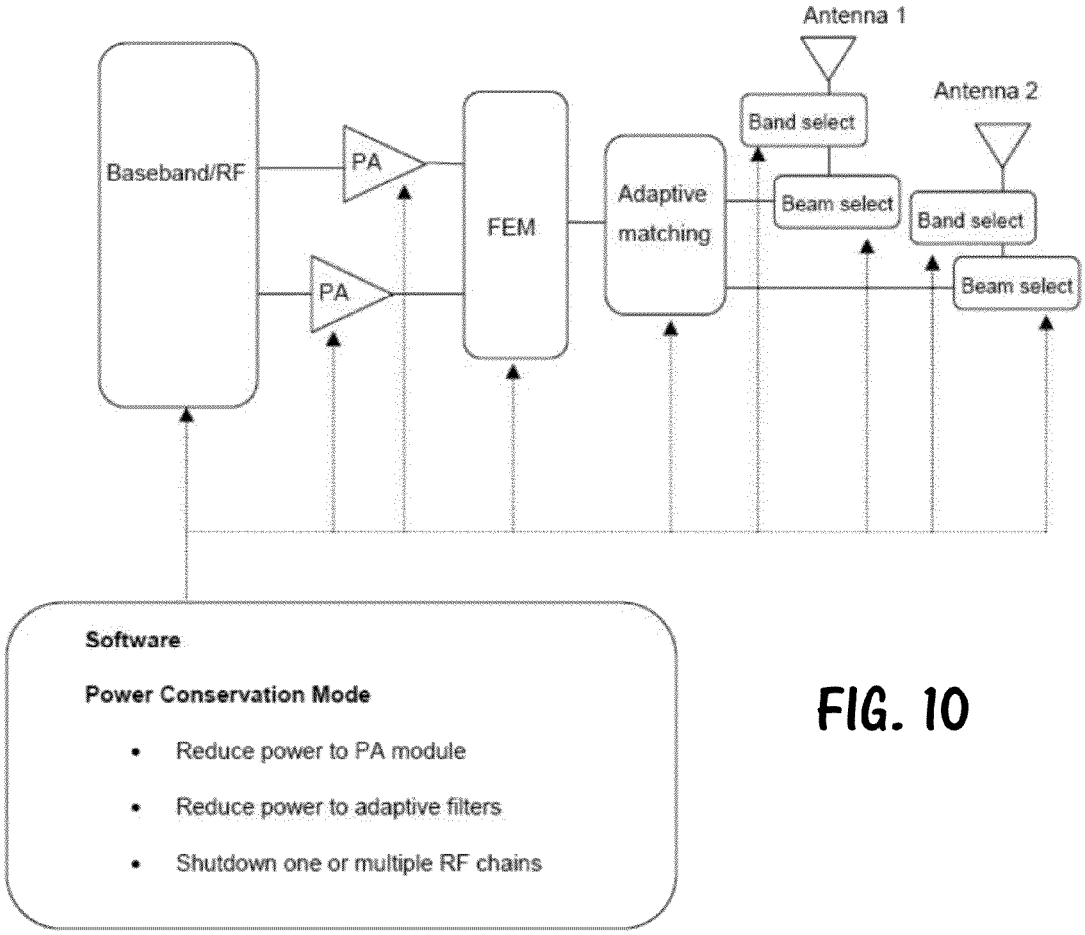
FIG. 10 illustrates a tunable front end module programmed to function in a "power conservation mode".

FIG. 10 illustrates the dynamically tunable FEM described in FIG. 6 where a power conservation mode algorithm is implemented to conserve power by reducing power to the PA modules, adaptive filters, and shutting down un-used RF chains.

Figure 11:
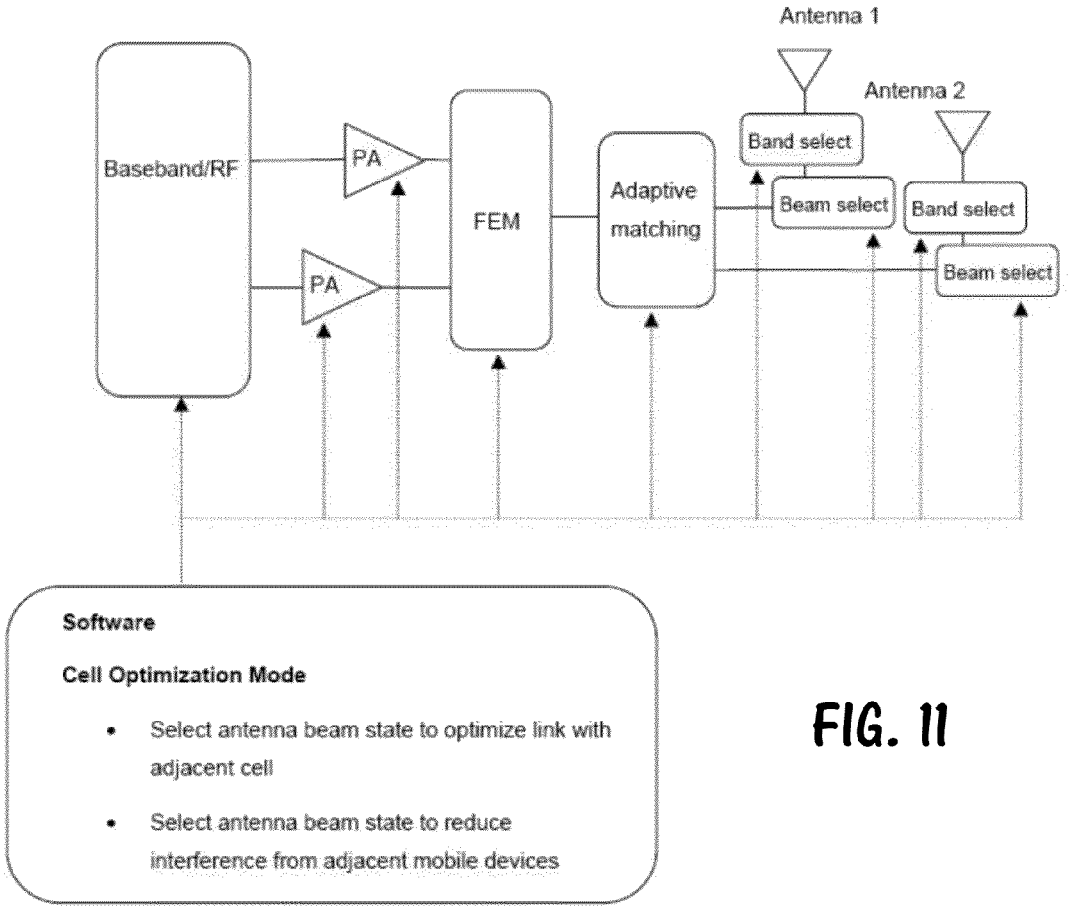
FIG. 11 illustrates a tunable front end module programmed to function in a "cell optimization mode".

FIG. 11 illustrates the dynamically tunable FEM described in FIG. 6 where a cell optimization mode algorithm is implemented to improve communication link performance of one or multiple communication systems within a cell. The cell optimization mode algorithm provides the ability to select antenna beam state to improve communication with an adjacent cell, thereby reducing required capacity in the first cell. The algorithm can also select the beam state of a communication system in a cell to reduce interference with other communication systems in the cell.

Figure 12:
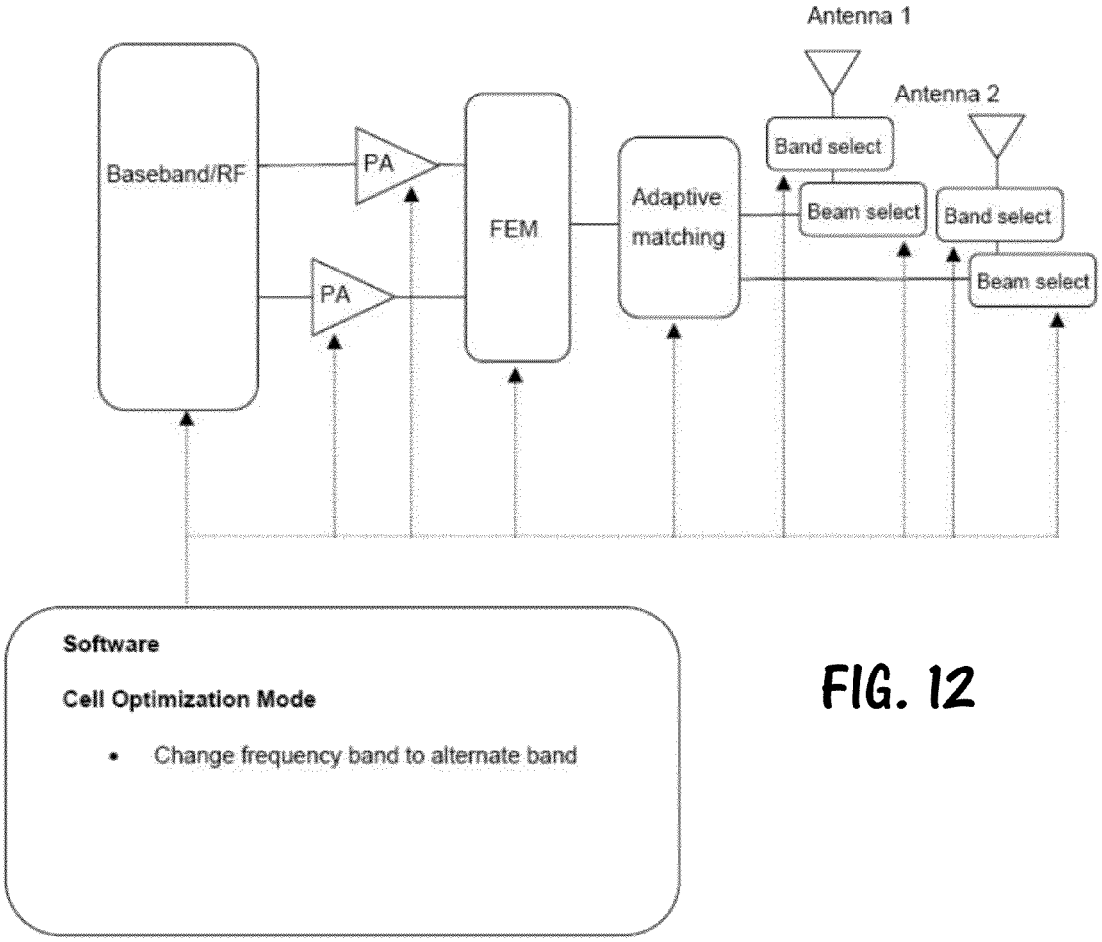
FIG. 12 illustrates a tunable front end module programmed to function in an alternative "cell optimization mode".

FIG. 12 illustrates the dynamically tunable FEM described in FIG. 6 where a cell optimization mode algorithm is implemented to improve communication link performance of one or multiple communication systems within a cell. The cell optimization mode algorithm provides the ability to change the frequency band of operation of one or multiple communication systems within a cell to improve overall cell performance.

Figure 13:
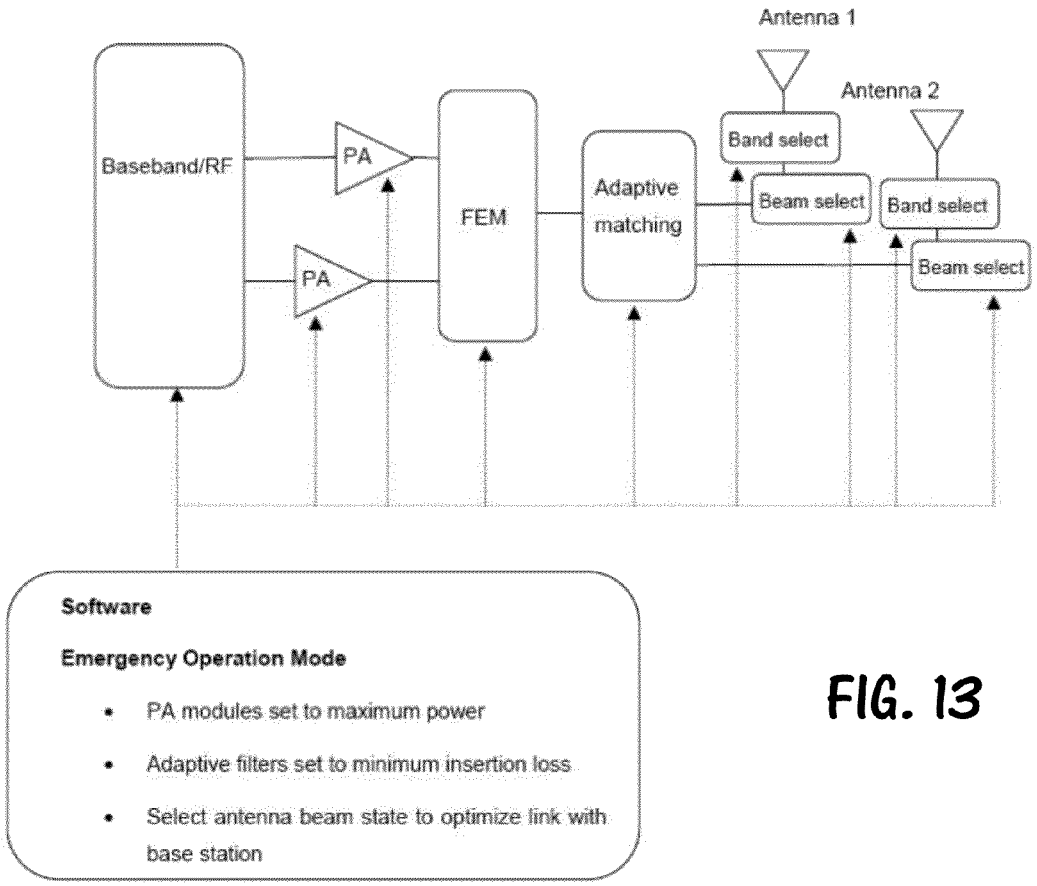
FIG. 13 illustrates a tunable front end module programmed to function in an "emergency operation mode".

FIG. 13 illustrates the dynamically tunable FEM described in FIG. 6 where an emergency operation mode algorithm is implemented to improve communication link performance of one or multiple communication systems during emergency situations. The emergency operation mode algorithm provides the ability to increase transmit power of one or multiple PA modules, dynamically adjust adaptive filters to minimize insertion loss, and select antenna beam state to optimize link with the base station.

Figure 14:
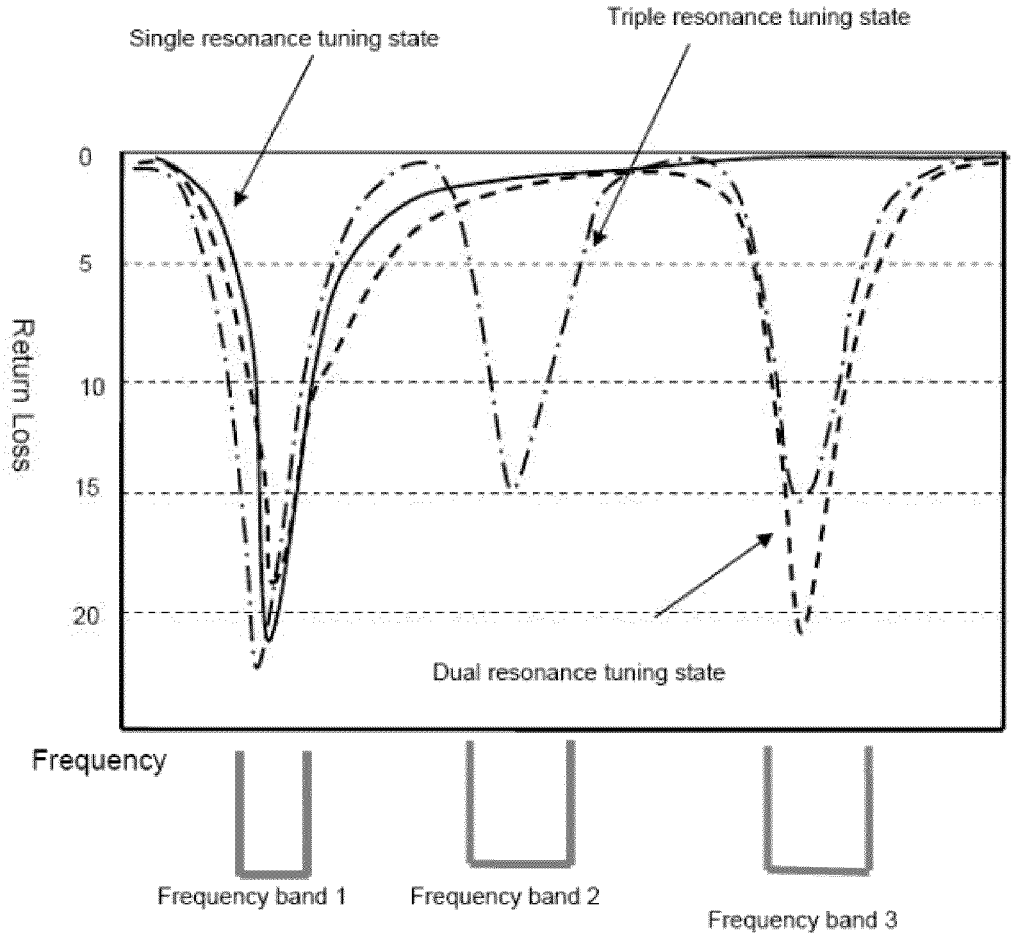
FIG. 14 illustrates a plot that shows the multiple tuning states that can be achieved with a dynamically tuned antenna system.

FIG. 14 illustrates a plot that shows the multiple tuning states that can be achieved with a dynamically tuned antenna system. The antenna can be tuned to optimize for a single resonance, dual resonance, or triple resonance. Additional resonances can be implemented.

Thus, in one embodiment a tunable front end module for use in a radio circuit comprises: one or more power amplifier modules coupled to a power amplifier bus, the power amplifier bus being further coupled to a baseband processor and a voltage ladder circuit; one or more adaptive filter modules, each of the adaptive filter modules being coupled to one of the power amplifier modules and adapted to filter signals received therefrom, the adaptive filter modules being further coupled to a filter bus and a decoder; and an active modal antenna; the tunable front end module further comprising a software algorithm programmed within a microprocessor or the baseband processor, the software algorithm being programmed to provide adaptive tuning of each of the power amplifier modules, adaptive filter modules, and active modal antenna for producing optimal transmission through the transceiver front end.

The active modal antenna comprises: a radiating structure disposed above a circuit board and forming an antenna volume therebetween; a parasitic element positioned adjacent to the radiating structure; and an active element coupled to the parasitic element; wherein the active element is configured for one or more of: adjusting a reactance of the parasitic element, or shorting the parasitic element to ground.

In one embodiment, the tunable front end module is programmed to: reduce power to one or more of the power amplifiers; reduce power to one or more of the active filter modules; and reduce power to one or more radiofrequency chains, resulting in operation of a voice channel only, or a data channel only; wherein the tunable front end module is adapted to operate in a power conservation mode.

In another embodiment, the tunable front end module is programmed to: select a mode of the active modal antenna having a beam state optimized to reduce interference and increase cell capacity with an adjacent base station; wherein the tunable front end module is adapted to operate in a first cell optimization mode.

In another embodiment, the tunable front end module is programmed to: select a frequency band for optimizing cell capacity, wherein the transceiver is commanded to switch to an alternate frequency band to relieve congestion within a cell; wherein the tunable front end module is adapted to operate in a second cell optimization mode.

In another embodiment, the tunable front end module is programmed to: configure the active modal antenna for operating with maximum radiated power; and configure the adaptive filter modules for reduced insertion loss to increase total radiated power; wherein the tunable front end module is adapted to operate in an emergency call mode.

In another embodiment, the tunable front end module comprises multiple active modal antennas configured in an array and adapted to increase antenna gain for increased total radiated power; wherein the tunable front end module is adapted to operate in an emergency call mode.

In another embodiment, the tunable front end module is programmed to: adjust correlation between antennas by selecting an optimal antenna beam state of one or more of the active modal antennas; and dynamically tuning portions of the tunable front end module to alter the impedance properties of one or more of transmit or receive paths.

In another embodiment, the tunable front end module is programmed to: adjust isolation between the active modal antennas by selecting the optimal antenna beam state of one or more of the active modal antennas; and dynamically tuning portions of the tunable front end module to alter the impedance properties of one or more of transmit or receive paths.

We claim:

1. A tunable front end module in a radio circuit, comprising:

one or more power amplifier modules coupled to a power amplifier bus, the power amplifier bus being further coupled to a baseband processor and a voltage ladder circuit;

one or more adaptive filter modules, each of the adaptive filter modules being coupled to one of said power amplifier modules and adapted to filter signals received therefrom, the adaptive filter modules being further coupled to a filter bus and a decoder; and an active modal antenna;

the tunable front end module further comprising a software algorithm programmed within a microprocessor or the baseband processor, the software algorithm being programmed to provide adaptive tuning of each of the power amplifier modules, adaptive filter modules, and active modal antenna for producing optimal transmission through the transceiver front end.

2. The tunable front end module of claim 1, said active modal antenna comprising:

a radiating structure disposed above a circuit board and forming an antenna volume therebetween;

a parasitic element positioned adjacent to the radiating structure; and an active element coupled to the parasitic element;

wherein said active element is configured for one or more of: adjusting a reactance of the parasitic element, or shorting the parasitic element to ground.

3. The tunable front end module of claim 1, the tunable front end module being programmed to:

reduce power to one or more of the power amplifiers;

reduce power to one or more of the active filter modules; and reduce power to one or more radiofrequency chains, resulting in operation of a voice channel only, or a data channel only;

wherein the tunable front end module is adapted to operate in a power conservation mode.

4. The tunable front end module of claim 1, the tunable front end module being programmed to:

select a mode of the active modal antenna having a beam state optimized to reduce interference and increase cell capacity with an adjacent base station;

wherein the tunable front end module is adapted to operate in a first cell optimization mode.

5. The tunable front end module of claim 1, the tunable front end module being programmed to:

select a frequency band for optimizing cell capacity, wherein the transceiver is commanded to switch to an alternate frequency band to relieve congestion within a cell;

wherein the tunable front end module is adapted to operate in a second cell optimization mode.

6. The tunable front end module of claim 1, the tunable front end module being programmed to:

configure the active modal antenna for operating with maximum radiated power; and configure the adaptive filter modules for reduced insertion loss to increase total radiated power;

wherein the tunable front end module is adapted to operate in an emergency call mode.

7. The tunable front end module of claim 6, comprising multiple active modal antennas configured in an array and adapted to increase antenna gain for increased total radiated power;

wherein the tunable front end module is adapted to operate in an emergency call mode.

8. The tunable front end module of claim 7, the tunable front end module being programmed to:

adjust correlation between antennas by selecting an optimal antenna beam state of one or more of the active modal antennas; and dynamically tuning portions of the tunable front end module to alter the impedance properties of one or more of transmit or receive paths.

9. The tunable front end module of claim 7, the tunable front end module being programmed to:

adjust isolation between the active modal antennas by selecting the optimal antenna beam state of one or more of the active modal antennas; and dynamically tuning portions of the tunable front end module to alter the impedance properties of one or more of transmit or receive paths.

* * * * *